United States Patent [19]

Fenne et al.

[11] 4,173,208

[45] Nov. 6, 1979

[54] FUEL SYSTEMS FOR AN INTERNAL COMBUSTION ENGINE

[75] Inventors: Ivor Fenne, Greenford; Boaz A. Jarrett, London, both of England

[73] Assignee: Lucas Industries Limited, Birmingham, England

[21] Appl. No.: 848,999

[22] Filed: Nov. 7, 1977

[30] Foreign Application Priority Data

Nov. 9, 1976 [GB] United Kingdom ..... 46677/76

[51] Int. Cl.[2] ..... F02D 5/02

[52] U.S. Cl. ..... 123/139 AT; 123/32 G; 123/139 AS

[58] Field of Search ..... 123/32 F, 32 G, 139 AS, 123/139 AT, 139 E

[56] References Cited

U.S. PATENT DOCUMENTS

| | | | |
|---|---|---|---|
| 4,082,481 | 4/1978 | Fenne | 123/139 AS X |
| 4,091,784 | 5/1978 | Seilly et al. | 123/139 AS X |

*Primary Examiner*—Charles J. Myhre
*Assistant Examiner*—Tony M. Argenbright

[57] ABSTRACT

A fuel injection system includes a first piston which can be subjected to fluid under pressure to cause displacement of a further piston, which causes delivery of fuel through an outlet. In addition a second piston is provided which is located in a cylinder communicating with the cylinder containing the first piston. The second piston is of smaller diameter and can also be subjected to fluid under pressure. When this occurs the second piston is moved and transfers fluid under pressure into the cylinder containing the first piston to achieve a limited delivery of fuel through the outlet. Valve means is provided to control the application of fluid pressure to the second piston and also the first piston.

10 Claims, 5 Drawing Figures

FUEL SYSTEMS FOR AN INTERNAL COMBUSTION ENGINE

This invention relates to a fuel system for an internal combustion engine, particularly a compression ignition engine.

According to the present invention, there is provided a fuel system for an internal combustion engine, comprising first piston means movable within a first cylinder to displace fuel at high pressure from one end of said first cylinder through an outlet, which in use, is connected to a fuel injection nozzle, second piston means movable within a second cylinder to displace a limited volume of fluid at pressure from one end of said second cylinder, and valve means operable such that in a first condition, said valve means enables fluid under pressure to be applied to said second piston means, whereby said second piston means is moved towards said one end of the second cylinder so as to displace fluid at pressure therefrom, and also enables said fluid at pressure displaced from said one end of the second cylinder to be applied to said first piston means, whereby said first piston means is moved towards said one end of the first cylinder so as to displace a limited volume of fuel through said outlet, in a second condition, said valve means enables fluid at pressure to be applied to said first piston means, whereby said first piston means is moved towards said one end of the first cylinder so as to displace fuel through said outlet, and in a third condition, said valve means enables said first piston means to be moved away from said one end of the first cylinder, said valve means in one of said second and third conditions also enabling said second piston means to be moved away from said one end of the second cylinder.

Preferably, said valve means in its third condition enables fluid at pressure displaced by said first piston means during movement of the latter away from said one end of the first cylinder to be applied to said second piston means, and also enables said second piston means to be moved away from said one end of the second cylinder.

Advantageously, a valve is provided which is operable so as to enable said first piston means to continue moving away from said one end of the first cylinder when said second piston means reaches a limit of its travel away from said one end of the second cylinder.

Conveniently, said valve is disposed in a conduit which by-passes said second piston means, and is preferably a non-return valve arranged to prevent flow therethrough of fluid under pressure applied to said second piston means when said valve means is in its first condition.

Most conveniently, said conduit is disposed in said second piston means and extends therethrough.

In alternative embodiment, the first valve is open in said second condition of the valve means, and the second valve is disposed in parallel with the second cylinder and in series with the first valve.

Embodiments of fuel systems in accordance with the invention will now be described by way of example, with reference to the accompanying drawings in which.

Figure 1:
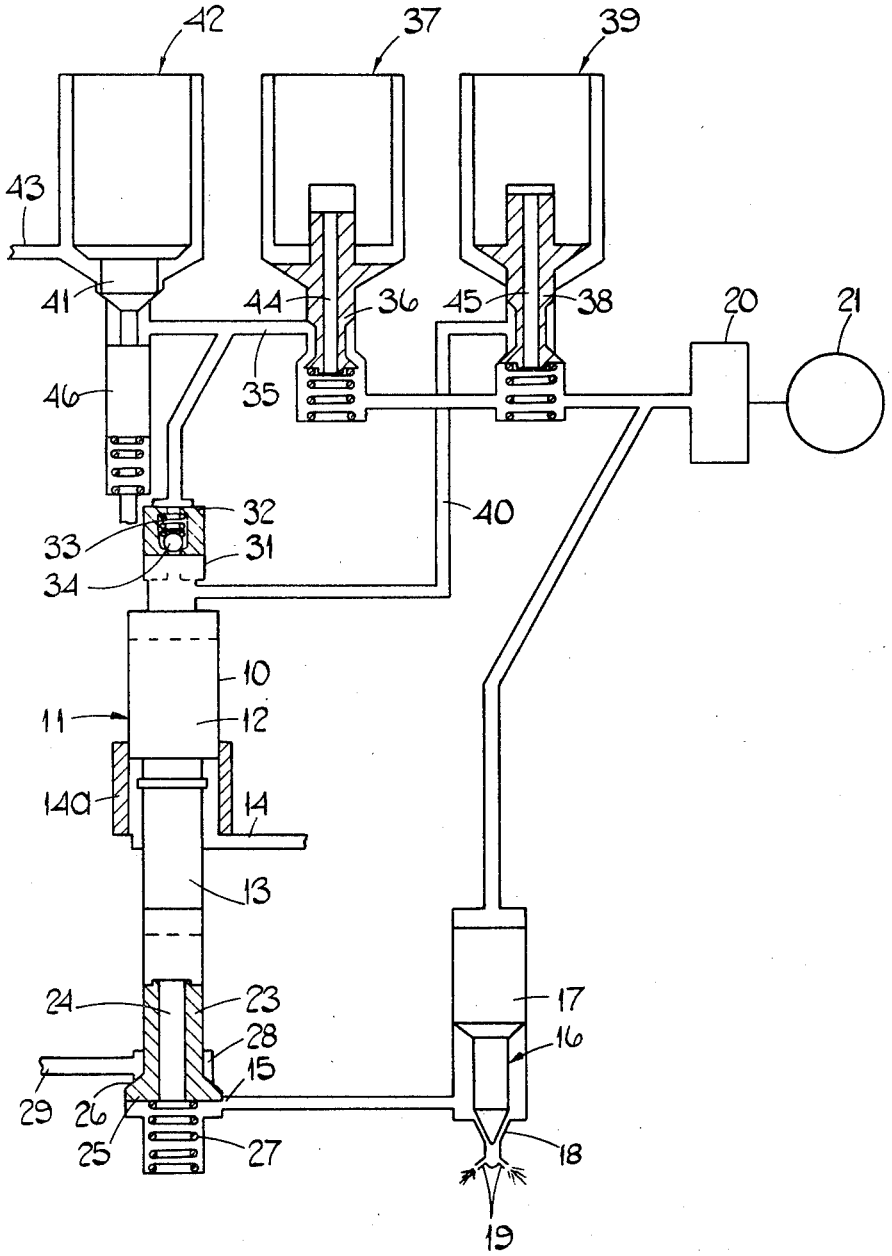
FIGS. 1, 2 and 3 are schematic illustrations of a first embodiment of a fuel system for an internal combustion engine, specifically a compression ignition engine, showing the system in respective stages of its operation.
Figure 2:
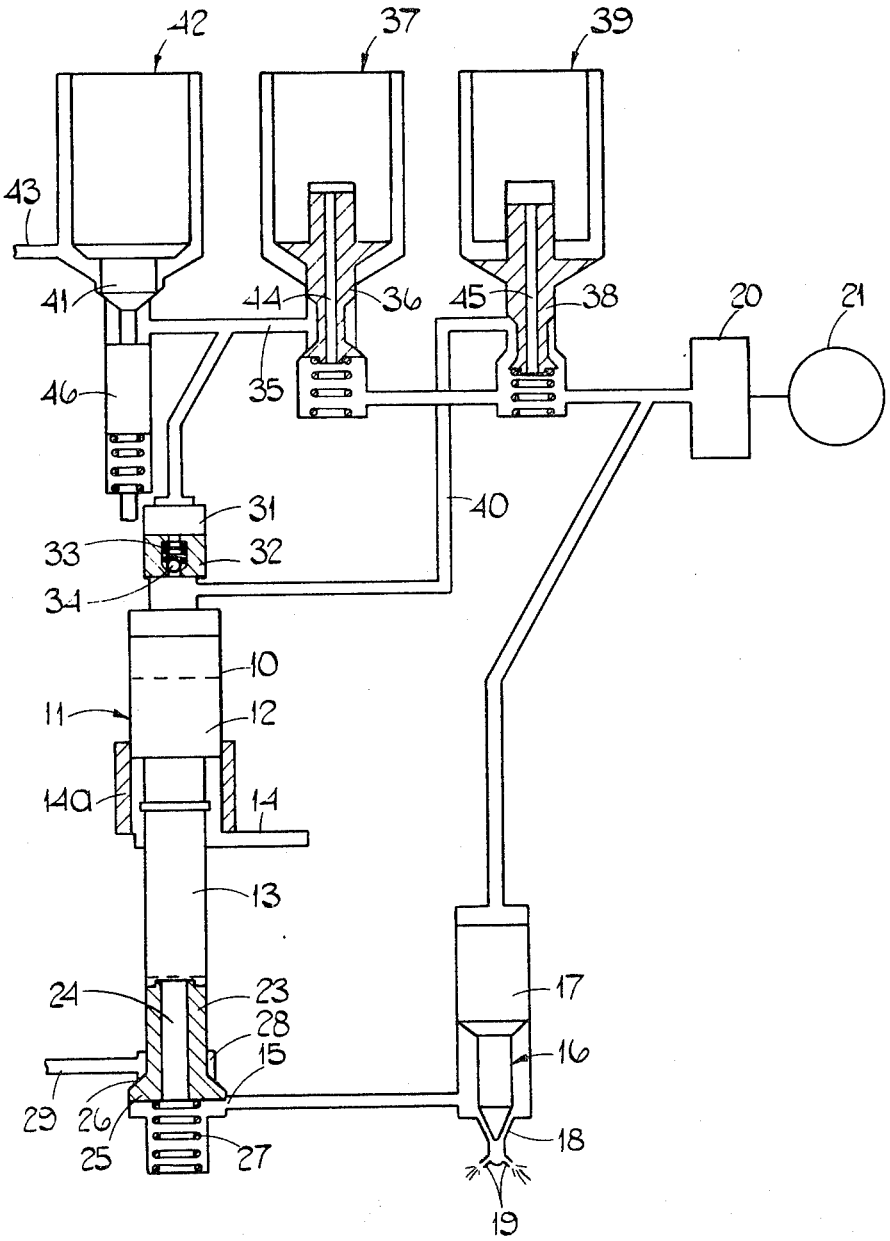
Figure 3:
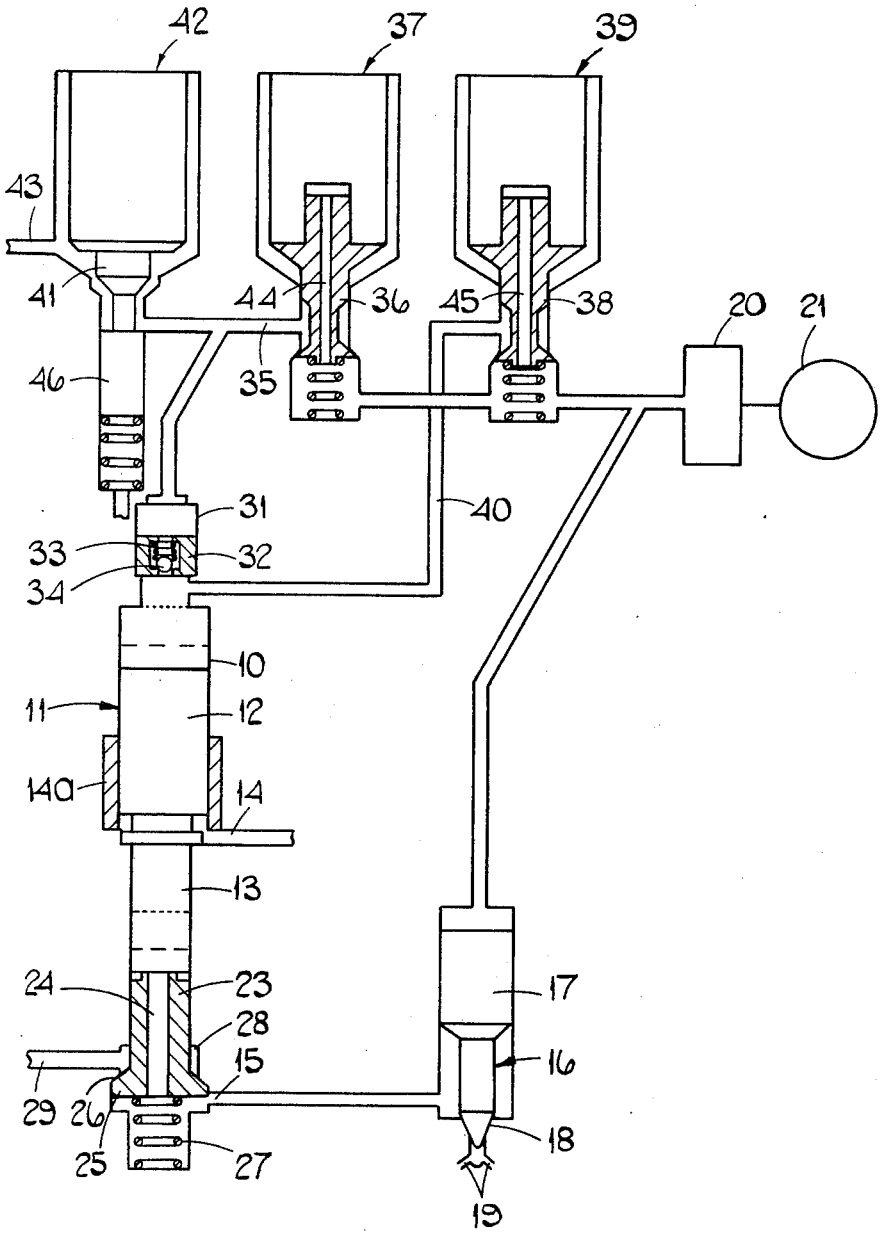

Referring first to FIGS. 1 to 3, the fuel system shown therein includes a stepped first cylinder 10 in which is located a composite first piston 11, which consists of an actuator piston 12 and a displacement piston 13. The displacement piston 13 is of a smaller diameter than the actuator piston 12, so that a step is defined in the piston 11 which is complementary to the step in the cylinder 10. A space intermediate the step in the piston 11 and the step in the cylinder 10 is vented to drain via passage 14. A detector coil 14 a surrounds the cylinder 10 and is adapted to detect the position of the piston 11 in the cylinder 10 when the system is in use.

The narrower end of the cylinder 10 communicates with an outlet 15 which is connected to a fuel injection nozzle 16. The fuel injection nozzle 16 includes a stepped valve member 17, the narrower end of which is of conical form and co-operates with a seating 18 to control the flow of fuel at high pressure through orifices 19 to a combustion chamber of a compression ignition engine (not shown). The opposite end of valve member 17 is subjected to a high pressure of fuel which is contained within an accumulator 20, to which fuel under pressure is supplied by means of a pump 21.

A valve element 23 is located in the narrower end of the cylinder 10. The valve element 23 has a passage 24 extending therethrough and a head 25 which is adapted to co-operate with a seating 26, the valve element 23 being biased into engagement, with the seating 26 by means of a spring 27. The head 25 is of slightly larger diameter than the narrower end of the cylinder 10, and an annular space 28 is defined in the cylinder 10 adjacent the head 25, which annular space 28 communicates with a source of fuel at low pressure (not shown) by way of a passage 29.

A second cylinder 31 communicates at one end thereof with the wider end of the cylinder 10. Disposed in the cylinder 31 and axially slidable therein is a second piston 32, which piston 32 has a conduit 33 extending therethrough and a non-return valve 34 located in the conduit 33. The other end of the cylinder 31 communicates with the accumulator 20 by means of a conduit 35, in which conduit 35 is disposed a valve element 36 of a first solenoid operated valve 37. A valve element 38 of a second solenoid operated valve 39 is disposed in a conduit 40 by which the space between the pistons 11 and 32 communicates with the accumulator 20. The valves 37 and 39 are thus in parallel. A valve element 41 of a third solenoid operated valve 42 is disposed in a conduit 43 by which the said other end of cylinder 31 communicates with drain. The valve elements 36, 38 and 41 are each arranged to be pressure balanced, the elements 36 and 38 by means of respective passages 44 and 45 extending therethrough and the element 41 by means of a dummy piston 46 connected thereto.

The fuel system operates as follows to allow pilot and main injection to take place. When pilot injection of fuel is required, a solenoid of the first solenoid operated valve 37 is energised so as to open the latter, the other two valves 39 and 42 being closed at this time. Fuel under pressure is then supplied from accumulator 20 to the said other end of cylinder 31 via conduit 35. The pressure of this fuel acts on the piston 32 so as to move the latter towards the said one end of cylinder 31, thereby displacing a limited volume of fuel at pressure from that end of the cylinder 31. The non-return valve 34 at this stage prevents fuel from flowing through the conduit 33 in the piston 32. Because conduit 40 is closed by valve 39, the fuel displaced from the said one end of the cylinder 31 flows into the wider end of cylinder 10. The pressure of this fuel acts on the piston 11 so as to move the latter towards the narrower end of the cylinder 10, and a limited volume of fuel, at high pressure is thereby displaced through the outlet 15 to the injection nozzle 16. The relative diameters of the pistons 12 and 13 are arranged such that the fuel supplied to the nozzle 16 is at a higher pressure than accumulator pressure, so that the valve member 17 is lifted off its seat 18, thereby permitting pilot injection to take place. Pilot injection continues until the piston 32 engages a stop at the said one end of cylinder 31, whereupon the piston 11 ceases to move. At this point, the pistons 32 and 11 are in the positions indicated by broken lines in FIG. 1 and solid lines in FIG. 2.

When main injection of fuel is required, a solenoid of the second solenoid operated valve 39 is energised so as to open the latter, the valve 42 at this stage being closed and the valve 37 optionally being closed. Fuel under pressure is supplied from the accumulator 20 to the space between the pistons 11 and 32 and acts on the piston 12 so as to move it further towards the narrower end of cylinder 10, and thereby displace fuel through the outlet 15 to the injection nozzle 16. Again, the relative diameters of the pistons 12 and 13 are such that the fuel supplied to the nozzle 16 is at a higher pressure than accumulator pressure, so that valve member 17 is lifted off its seat 18, thereby permitting main injection to take place.

The injection of fuel through the nozzle 16 continues until the piston 13 engages the valve element 23 as shown in broken lines in FIG. 2, and lifts it from the seat 26 as indicated in FIG. 3. When the valve element is lifted the pressure of fuel applied to the nozzle falls to that of the source to which the passage 29 is connected. The valve element 17 of the nozzle therefore closes.

In order to return the system to the start condition the valves 37 and 39 are closed and a solenoid of the valve 42 energised to open valve 42. The pressure of fuel supplied through the passage 29 is sufficient to hold the valve head 25 off the seating and the fuel flows into the narrower end of the cylinder 10 forcing the pistons 13 and 12 upwardly. During the initial movement the piston 32 is also moved upwardly but when this movement is halted by its engagement with the end of the cylinder 31, the valve member 34 is lifted from its seating to allow fuel in the wider end of the cylinder 10 to be displaced to drain. The extent of movement of the pistons 12, 13 is sensed by the coil 14*a* and when the desired volume of fuel has entered the narrower end of the cylinder 10 the valve 42 is closed. A hydraulic lock is thus created and the movement of the pistons is halted. The valve head 25 then becomes pressure balanced and it is urged at the seating 26 by the action of the spring 27.

Figure 4:
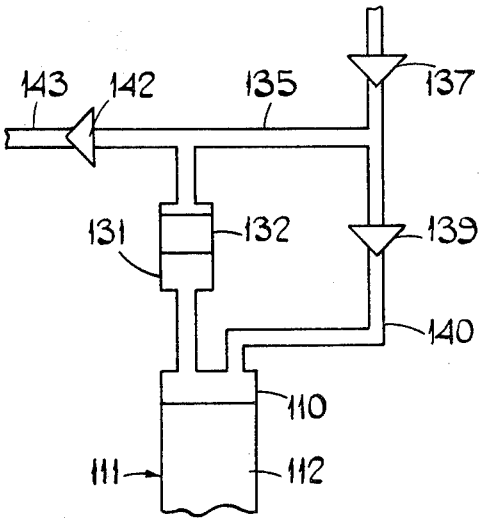
FIG. 4 is a schematic illustration of a second embodiment of a fuel system and, FIG. 5 is a schematic illustration of a modification of the embodiment of FIG. 4.

A second embodiment of the fuel system is shown in FIG. 4, and is similar to that described above in relation to FIGS. 1 to 3, similar parts being accorded the same reference numerals with 100 added. However, in this embodiment, the second solenoid operated valve 139 is disposed in parallel with the second cylinder 131 and in series with the first solenoid operated valve 137; also, no non-return valve is provided in the second piston 132. As will be described, this arrangement enables injection to be effected either in two stages (i.e. a pilot stage and a main stage) or in a single stage. Where two stage injection is required, pilot injection is performed by opening valve 137, valves 139 and 142 being closed at this time. Fuel under pressure is applied to the second piston 132 from the accumulator (not shown) so as to move the first piston means 111 and perform a pilot fuel injection in the same manner as described above in relation to FIGS. 1 to 3. When the main injection is required, valve 139 is opened, valve 142 remaining closed. Fuel under pressure from the accumulator is applied to the actuator piston 112 via both of the valves 137 and 139, thereby moving the first piston means 111 so as to perform a main fuel injection again in the same manner as described above.

In order to return the system to its starting condition valves 137 and 139 are closed and valve 142 is opened. At the same time, fuel at low pressure is applied to the displacement piston (not shown) of the first piston means 111 so as to move the latter upwardly as viewed in the drawing. Because valve 139 is closed, fuel displaced from the first cylinder 110 by the actuator piston 112 acts on the second piston 132 to move the latter upwardly also. When the second piston 132 reaches its starting position at the end of the second cylinder 131, valve 139 is opened to permit the first piston means 111 to continue its upward movement and to return to its desired starting position, fuel displaced by the actuator piston 112, flowing to drain via the conduit 143. When the first piston means 111 reaches its desired starting position, valve 142 is closed to prevent it from travelling further upwardly.

Where single stage injection is required, valve 139 is held open throughout the injection and filling cycle so that the second cylinder 131 is by-passed and the second piston 132 is thereby rendered ineffective. Injection is performed by opening valve 137 whilst holding valve 142 closed, so that fuel at accumulator pressure is applied to the actuator piston 112 via the valves 137 and 139. The system is therefore returned to its initial condition by closing valve 137, opening valve 142, and applying fuel at low pressure to the displacement piston (not shown) of the first piston means 111. When the piston means 111 has returned to its desired starting position, valve 142 is closed and the injection cycle can then be repeated by re-opening valve 137.

Figure 5:
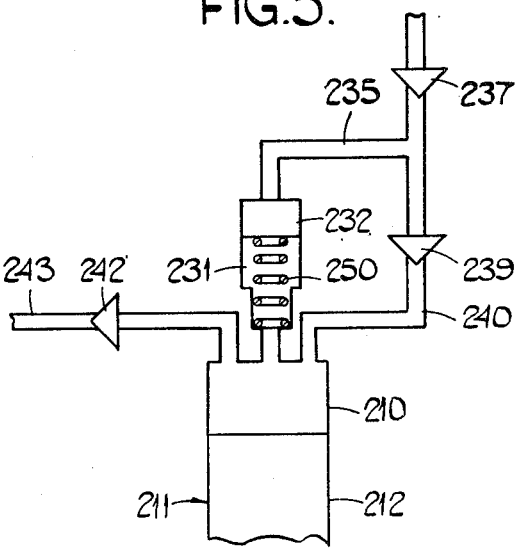

FIG. 5 illustrates a modification of the fuel system shown in FIG. 4, similar parts being accorded the same reference numerals with 100 added. In this embodiment, the conduit 243 in which the valve 242 is disposed is connected directly to the said other end of the first cylinder 210; also, the second piston 232 is biased by a spring 250 towards the said other end of the second cylinder 231. This arrangement, like that of FIG. 4, enables injection to be performed either in two stages or in a single stage.

Where two-stage injection is required, pilot injection is effected by opening valve 237 whilst keeping valves 239 and 242 closed, and main injection is performed by opening valve 239 whilst maintaining valve 237 open and valve 242 closed, in the same manner as described above in relation to FIG. 4. When the system is to be returned to its starting condition, valve 237 is closed and valve 242 is opened, valve 239 being held open at this time. Fuel at low pressure is also applied to the displacement piston (not shown) of the first piston means 211 so as to cause the latter to move upwardly. As the piston means 211 moves upwardly, the second piston 232 is returned to its starting position at the said other end of the cylinder 231 partly under the action of fuel displaced by the actuator piston 212 but mainly under the action of the spring 250. When the first piston means 211 has returned to its desired starting position, valves 239 and 242 are closed.

Single-stage injection is effected in exactly the same way as for the system of FIG. 4, the valve 239 being held open throughout the injection cycle so as to by-pass the cylinder 231 and render the piston 232 ineffective.

If desired, a restrictor (not shown) may be provided in the conduit 235 which connect the cylinder 231 to the accumulator (not shown) via the valve 237, so as to control the rate at which fuel is supplied to the cylinder 231 during pilot injection. In this way, pilot injection can be performed at a slower rate than before.

In any one of the above mentioned embodiments, a mechanically adjustable stop (not shown) may be provided in the second cylinder 231 to limit the stroke of the second piston 232 and therefore control the amount of fuel which is injected into the combustion chamber of the engine during pilot injection. It is envisaged that a system thus modified may be used as a test apparatus to determine the optimum conditions of fuel injection for different engines.

We claim:

1. A fuel system for connection to a fuel injection nozzle of an internal combustion engine, comprising a first cylinder having a first outlet, first piston means movable within said first cylinder to displace fuel at high pressure from one end of said first cylinder through said outlet to a fuel injection nozzle, a second cylinder having a second outlet, second piston means movable within said second cylinder to displace a limited volume of fluid at pressure from one end of said second cylinder through said second outlet, passage means connecting said second outlet to said first cylinder, and valve means having means operably connecting said first and second cylinders and adapted to supply, in a first condition, fluid under pressure to said second piston means for moving said second piston means towards said one end of the second cylinder so as to displace fluid at pressure therefrom, and also said fluid at pressure displaced from said one end of the second cylinder to said first cylinder to be applied to said first piston means through said passage means, for moving said first piston means towards said one end of the first cylinder so as to displace a limited volume of fuel through said first outlet, said means operably connecting said first and second cylinders being adapted to apply in a second condition, fluid at pressure to said first piston means, whereby said first piston means is moved towards said one end of the first cylinder so as to displace fuel through said first outlet, and said means operably connecting said first and second cylinders enabling, in a third condition, said first piston means to be moved away from said one end of the first cylinder, and also enabling in one of said second and third conditions, said second piston means to be moved away from said one end of the second cylinder.

2. A system according to claim 1 in which said connecting means of said valve means in its third condition enables fluid at pressure displaced by said first piston means during movement of the latter away from said one end of the first cylinder to be applied to said second piston means, and also enables said second piston means to be moved away from said one end of the second cylinder.

3. A system according to claim 2 including a valve operable so as to enable said first piston means to continue moving away from said one end of the first cylinder when said second piston means reaches a limit of its travel away from said one end of the second cylinder.

4. A system according to claim 3, which comprises a conduit by-passing said second piston means, and in which said valve is disposed in said conduit.

5. A system according to claim 4, in which said valve is a non-return valve arranged in said conduit to prevent flow therethrough of fluid under pressure applied to said second piston means when said valve means is in its first condition.

6. A system according to claim 4 in which said conduit is formed in said second piston means and extends therethrough.

7. A system according to claim 4, in which said valve means comprises first, second and third control valves, the first of said valves being operable via said means operably connecting said first and second cylinders to place the other end of said second cylinder in communication with a source of fluid, the second of said valves being operable via said operable connecting means to place the other end of said first cylinder in communication with said source of fluid, and the third of said valves being operable via said operable connecting means to place the other end of said second cylinder in communication with a drain.

8. A system according to claim 2, in which said valve means comprises first, second and third control valves, the first of said valves being operable via said means operably connecting said first and second cylinders to place the other end of said second cylinder in communication with a source of fluid, the second of said valves being operable via said operable connecting means to place the opposite ends of said second cylinder in communication with each other and the third of said valves being operable via said operable connecting means to place the other end of said second cylinder in communication with a drain.

9. A system according to claim 2, in which said valve means comprises first, second and third control valves, the first of said valves being operable via said means operably connecting said first and second cylinders to place the other end of said second cylinder in communication with a source of fluid, the second of said valves being operable via said operable connecting means to place the opposite ends of the second cylinder in communication with each other and the third of said valves being operable via said operable connecting means to place the other end of said first cylinder in communication with a drain.

10. A system according to claim 7 in which said control valves are solenoid operated.

* * * * *